US007096791B2

(12) United States Patent
Vanmoor

(10) Patent No.: US 7,096,791 B2
(45) Date of Patent: Aug. 29, 2006

(54) PROJECTILE WITH IMPROVED DYNAMIC SHAPE

(76) Inventor: Arthur Vanmoor, P.M.B. 219, 22 SE. 4th St., Boca Raton, FL (US) 33432

( * ) Notice: Subject to any disclaimer, the term of this patent is extended or adjusted under 35 U.S.C. 154(b) by 632 days.

(21) Appl. No.: 10/194,739

(22) Filed: Jul. 12, 2002

(65) Prior Publication Data

US 2004/0007148 A1 Jan. 15, 2004

(51) Int. Cl.
*F42B 10/42* (2006.01)

(52) U.S. Cl. ..... 102/501

(58) Field of Classification Search ..... 102/501, 102/503, 504, 508, 509, 517, 518, 519, 439; D22/116

See application file for complete search history.

(56) References Cited

U.S. PATENT DOCUMENTS 4,517,897 A * 5/1985 Kneubuhl ..... 102/439
4,572,077 A * 2/1986 Antoine et al. ..... 102/439
4,708,063 A * 11/1987 Ladriere ..... 102/516
4,932,306 A * 6/1990 Rom ..... 89/8
4,977,834 A * 12/1990 Denis ..... 102/439
5,058,503 A * 10/1991 Adams ..... 102/501
5,133,261 A * 7/1992 Kelsey, Jr. ..... 102/439
5,164,538 A * 11/1992 McClain, III ..... 102/517
D343,439 S * 1/1994 Kuczewski ..... D22/116
5,798,478 A * 8/1998 Beal ..... 102/501
D435,887 S * 1/2001 Benini ..... D22/116
6,305,293 B1 * 10/2001 Fry et al. ..... 102/517
6,439,126 B1 * 8/2002 Kennedy et al. ..... 102/516
6,474,593 B1 * 11/2002 Lipeles et al. ..... 244/3.21

FOREIGN PATENT DOCUMENTS

FR 839861 * 4/1939
GB 2236 * 6/1911

* cited by examiner

*Primary Examiner*—Peter M. Poon
*Assistant Examiner*—David Parsley
(74) *Attorney, Agent, or Firm*—Laurence A. Greenberg; Werner H. Stemer; Ralph E. Locher

(57) ABSTRACT

A projectile that is primarily suited for supersonic flight, such as a bullet, a shell, or a rocket, incorporates the model of the natural wave behavior. The leading edge of the projectile has a sharp tip which merges smoothly into a cylindrical body. The merging segment from the tip to the cylinder may be defined with a tangent function. The rounding of the surfaces promote proper fluid sheet formation along the surface and to reduce undesirable vortice formation and thus to reduce the value of several drag factors.

13 Claims, 2 Drawing Sheets

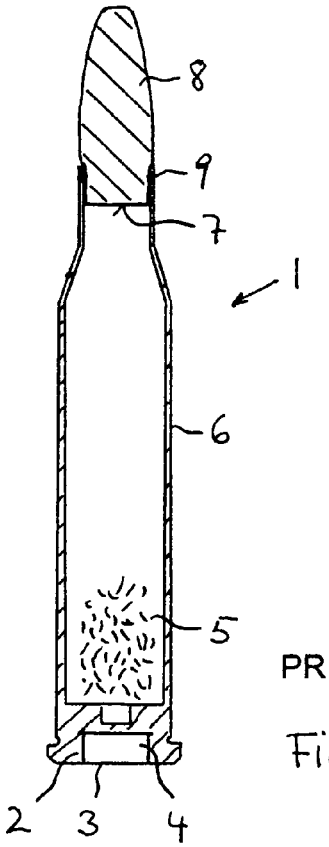
PRIOR ART
Fig 1
Fig 3
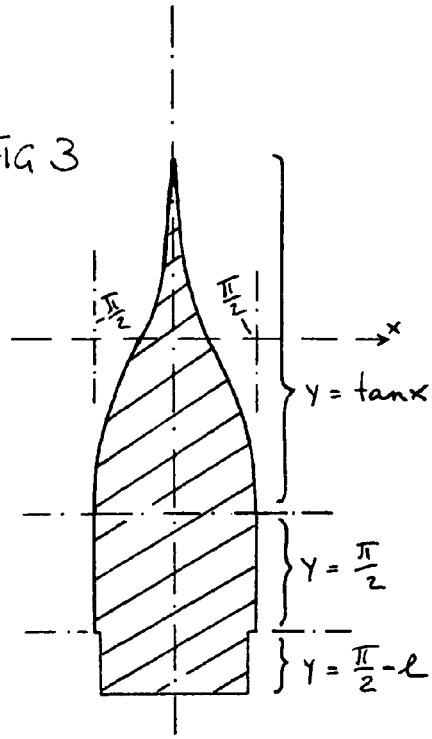
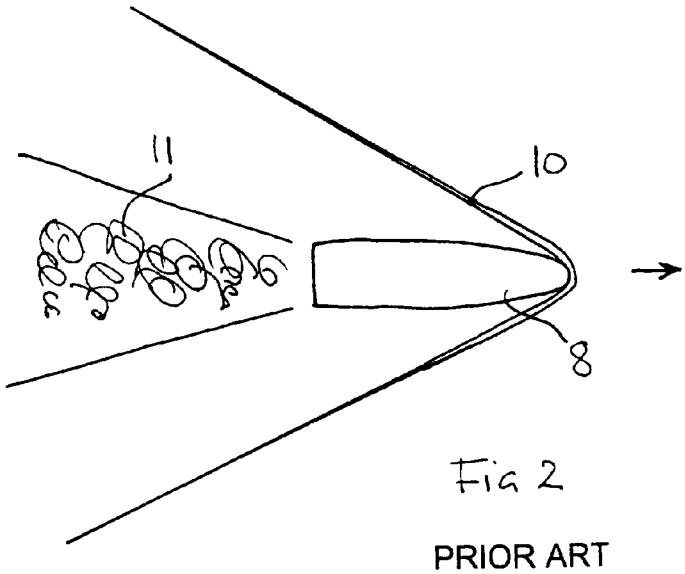
Fig 2
PRIOR ART

PROJECTILE WITH IMPROVED DYNAMIC SHAPE

BACKGROUND OF THE INVENTION

Field of the Invention

The invention lies in the field of ballistics and fluid dynamics. In particular, the invention pertains to structures with novel aerodynamic shapes.

Ballistics is generally divided into three distinct categories, namely, interior ballistics, exterior ballistics, and terminal ballistics. The invention is concerned primarily with exterior ballistics, which deals with the flight path and flight behavior of the projectile from the muzzle exit to target impact. Since the invention is primarily concerned with the shape of the projectile, it is of little import whether the projectile is passive (e.g., solid bullet, charge-loaded grenade) or self-propelled (e.g., rocket, guided bomb).

A variety of factors influence the flight behavior of projectiles. First and foremost, the pressure of the carrier medium at the bow establishes the primary drag factor. In the case of atmospheric flight, the pressure of the atmosphere causes a shock wave that resists the projectile flight. The next drag factor is the projectile skin friction. Flight inefficiency is affected by micro-friction between the exposed surfaces and the innermost layer (flow sheet) of the fluid impinging and being deflected by the surfaces. Surface roughness and minor convolutions on the surface are detrimental factors. Third, the base drag is the energy that is lost from the kinetic energy of the projectile to form turbulence flows at the rear of the projectile.

In addition, projectiles are subject wobble and precession which has a further destabilizing effect. The so-called Magnus force includes a moment (the Magnus moment), which tries to rotate a bullet about its longitudinal axis. Depending on the yaw angle (the angular difference between the flight axis and the longitudinal axis of the projectile), the Magnus moment may have a stabilizing or a destabilizing effect. The latter is true when the center of pressure on the projectile lies forward of the center of gravity. In many velocity ranges, this is in effect true and the Magnus force will cause considerable destabilization of the projectile.

SUMMARY OF THE INVENTION

It is accordingly an object of the invention to provide a novel projectile shape, which alleviates the above-mentioned disadvantages of the heretofore-known devices of this general type and which proposes a novel principle in projectile shape design that further minimizes projectile drag in a wide range of travel velocities.

With the foregoing and other objects in view there is provided, in accordance with the invention, a projectile configuration, comprising:

a cylindrical body segment having a center axis and a periphery;

a tip segment adjoining the cylindrical body segment and smoothly merging from the cylindrical body segment to a tip, the tip segment being defined, in section, by a function $y=s \tan x$, where x and y are Cartesian coordinates and y extends parallel to the center axis, and s is a real number greater than zero.

In accordance with an added feature of the invention, s is a number greater than 1. In one embodiment of the invention, the factor s is a constant. In another embodiment, the factor s is a function of x and has a maximum value smaller than a maximum value of x.

In accordance with an additional feature of the invention, the projectile has a tail segment adjoining the cylindrical body segment opposite from the tip segment and smoothly merging from the cylindrical body segment to a tail. The tail segment is defined, in section, by a function mirroring the function $y=s \tan x$ of the tip segment. In this embodiment, the projectile is substantially mirror-symmetric relative to a plane that is cut orthogonally through the central cylindrical body segment.

In accordance with another feature of the invention, the tail segment adjoining the cylindrical body segment opposite from the tip segment has a flat backwall substantially orthogonal to the longitudinal axis.

In accordance with a concomitant feature of the invention, the tail segment adjoining the cylindrical body segment is substantially hollow.

The novel concept for a projectile is primarily suited for supersonic flight. It is applicable for bullets, shells, or rockets. The configuration incorporates the model of the natural wave behavior. The leading edge of the projectile has a sharp tip which merges smoothly into a cylindrical body. The merging segment from the tip to the cylinder may be defined with a tangent function. The rounding of the surfaces promote proper fluid sheet formation along the surface and to reduce undesirable vortice formation and thus to reduce the value of several drag factors.

Other features which are considered as characteristic for the invention are set forth in the appended claims.

Although the invention is illustrated and described herein as embodied in a novel projectile shape, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a longitudinal section taken through a prior art rifle cartridge with a flat-nosed bullet;

FIG. 2 is a wind tunnel diagram illustrating the aerodynamic behavior of a prior art bullet;

FIG. 3 is a longitudinal sectional view of a bullet according to the invention;

DESCRIPTION OF THE PREFERRED EMBODIMENTS

Figure 4:
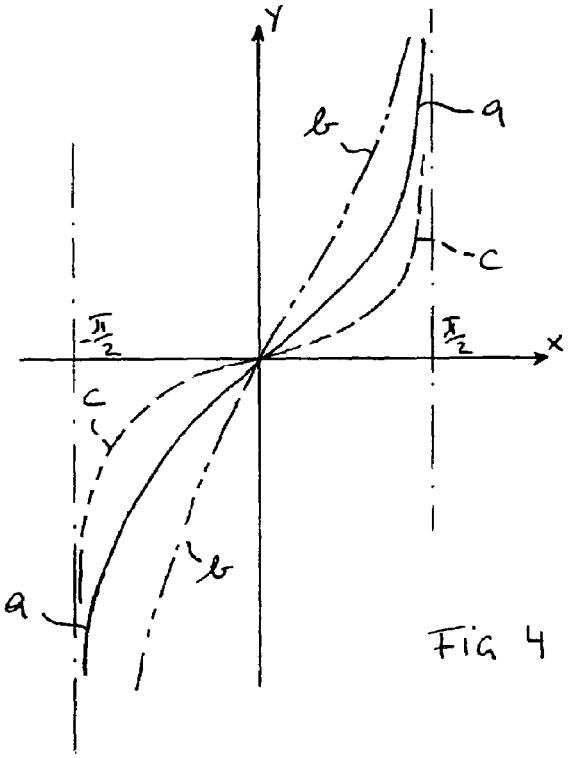
FIG. 4 is a diagram illustrating various functions to circumscribe the tip and/or tail segment of the novel projectile.

Referring now to the figures of the drawing in detail and first, particularly, to FIG. 1 thereof, there is seen a rifle cartridge 1. The cartridge 1 is illustrated as a centerfire cartridge with an anvil 2, a primer cap 3 and a priming mixture 4. Explosive powder 5 is housed in a metal cartridge case 6. The powder chamber reaches to a backwall 7 of a bullet 8. The bullet 8 is held in the cartridge case 6 by a crimping groove, a so-called cannelure 9.

The bullet 8 illustrated in FIG. 1 has a typical shape for current state of the art rifle bullets. By way of example, the illustrated cartridge may be an 8 mm Remington Magnum with a range of bullet weights from 125 grains to 220 grains.

Referring now to FIG. 2, the resistance to flight of a bullet is best illustrated in a wind tunnel diagram. Here, the bullet 8 is subject to a conical forward shockwave 10. The forward shockwave is an atmospheric disturbance which occurs essentially only in supersonic flight. At the speed of sound, Mach 1, the shockwave 10 is approximately flat and perpendicular to the flight path. As the flight speed increases, the shockwave bends backward to become flatter along the bullet contour. The cone angle is inversely proportional to the speed of the projectile. For example, at a speed of Mach 1.4, the shockwave has an apex angle of approximately 90° and at Mach 2.4 the apex angle in front of the projectile is approximately 50°.

The second important drag factor is the energy loss due to the tail turbulence 11 behind the projectile. In subsonic flight, this is the primary drag factor. These losses remain substantially constant within a wide speed range and well into the supersonic range.

The third drag factor is referred to as skin friction. Surface roughness and minor convolutions on the body of the projectile have a negative influence on the projectile flight.

These three drag factors are further influenced, or their importance is reduced, upon a yawing motion of the projectile. Yaw is defined as the angular difference between the longitudinal axis of the projectile and its flight path axis. The bullet diagram of FIG. 2 is illustrated at zero yaw. In order to render a projectile dynamically stable, the same is rotated during flight. This adds a gyroscopic component to its force vectors and the projectile becomes dynamically stable even when its pressure center is forward of its center of gravity.

Referring now to FIG. 3, there is illustrated a bullet according to the invention with a novel forward shape. While the bullet is shown as a solid structure, it may also be a jacketed, partly jacketed, or hollow body structure. The forward shape, in the illustrated section, can be defined in geometric terms by a tan function (and/or an arctan function). As shown, the rotationally symmetric shape has a tip that is modeled as $y=\tan x$ rotated about its terminal limit $\pi/2$ or $-\pi/2$. The tip is followed by a cylindrical segment $y=\pi/2$ and a further cylindrical segment with a slightly reduced diameter $y=(\pi/2)-1$.

Depending on the application and the maximized speed behavior of the projectile, the forward tip segment may be varied within a given range of designs. With reference to FIG. 4, the tip may be flattened by multiplying the envelope curve with a factor greater than 1 and made more pronounced with a factor less than 1. The curves a, b, and c are as follows:

a: $y=\tan x$ b: $y=s\cdot\tan x$ . . . $s>1$ c: $y=s\tan x$ . . . $s<1$.

Furthermore, the factor s may also be a function instead of a constant. That is, s can be defined as a function of x so that the "flattening" of the tip jacket varies. The function $s=f(x)$ can be maximized according to the respective application of the projectile and in terms of ease of manufacture.

Figure 5:
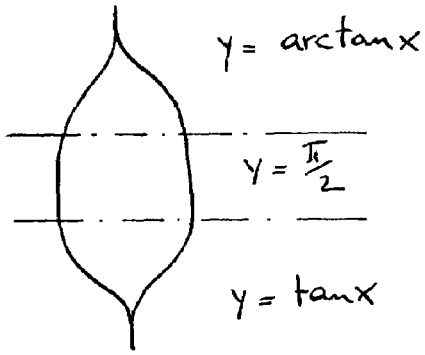
FIG. 5 is a longitudinal sectional view of a second embodiment of the projectile according to the invention.

Referring now to FIG. 5, the projectile may also maximized with regard to its tail section. Instead of the flat tail, the bullet 8 of FIG. 5 has the same tail shape as its tip. As illustrated, the bullet has three segments, namely, the forward tip segment that follows the tangent function, a cylindrical middle segment, and a trailing tail segment which again follows the tangent function. While the forward compression cone behavior of this embodiment may be the same as with the projectile of FIG. 3, the tail turbulence drag of the second embodiment is likely reduced in a wide range of speeds.

Figure 6:
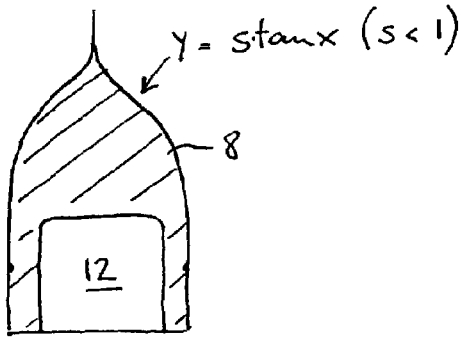
FIG. 6 is a longitudinal sectional view of a third embodiment of the projectile according to the invention.

With reference to FIG. 6, the otherwise flat tail segment of the bullet 8 may also be bored out to form a hollow tail chamber 12. A projectile is statically stable when its center of pressure (the cumulative attack point of all of the drag vectors) is behind its center of gravity. Dynamic stability is achieved by adding the spin rotation and thus introducing the gyroscopic component. The spin rotation which, in the case of bullets, is introduced by rifling grooves in the barrel, however leads to undesirable wobble and precession of the projectile (due to the Magnus moment) in several speed ranges. The necessity for the spin rotation can be further reduced with the configuration according to FIG. 6. Here, the center of gravity of the bullet 8 is far forward of the geometric center defined by the outline, so that the third embodiment of the novel bullet 8 will have a tendency towards static and dynamic stability. It should be understood that the bore 12 may also be substituted by a lighter material, i.e., it may be filled with a material that is lighter than the heavy material at the tip segment of the bullet.

Figure 7:
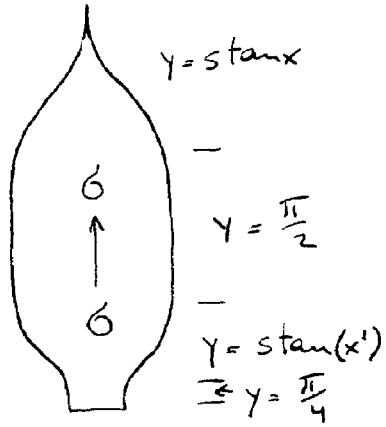
FIG. 7 is a longitudinal sectional view of a fourth embodiment of the projectile according to the invention.

Referring now to FIG. 7, there is illustrated a further variation of the principles of the invention. Here, the tail segment is first reduced by a tangent function that sweeps a range of x that is about half of the x sweep of the tip segment. Following the tangent curve, the tail segment of the fourth embodiment ends in a small cylindrical segment. The latter may be described with a rotation, about the longitudinal axis of the bullet, of a straight line $y=\pi/4$ or the like. More generally, the line can be described as $y=\pi/q$, where $q>2$.

FIG. 7 illustrates a further feature of the invention: in order to provide for the center of gravity to be forward as far as possible, the density and/or weight and/or specific weight of the material becomes greater from the tail to the tip. That is, the center of gravity moves forward while the center of pressure—which is dictated only by the outline shape of the projectile—will have a tendency to remain behind the center of gravity. As noted above, the result of this relationship is an increased stability of the projectile in static as well as dynamic terms.

I claim:

1. A projectile configuration, comprising:

a cylindrical body segment having a center axis and a periphery;

a tip segment adjoining said cylindrical body segment and smoothly merging from said cylindrical body segment to a tip, said tip segment being defined, in section, by a function $y=s\tan x$, where x and y are Cartesian coordinates and y extends parallel to said center axis, x extends in value from substantially $-\pi/2$ to substantially $+\pi/2$ and s is a real number greater than zero.

2. The projectile configuration according to claim 1, wherein s is a number greater than 1.

3. The projectile configuration according to claim 1, wherein s is a constant.

4. The projectile configuration according to claim 1, wherein s is a function of x and has a maximum value smaller than a maximum value of x.

5. The configuration according to claim 1, which comprises a tail segment adjoining said cylindrical body segment opposite from said tip segment and smoothly merging from said cylindrical body segment to a tail, said tail segment being defined, in section, by a function mirroring the function y=s tan x of the tip segment.

6. The configuration according to claim 1, which comprises a tail segment adjoining sad cylindrical body segment opposite from said tip segment and having a backwall substantially orthogonal to said longitudinal axis.

7. The configuration according to claim 6, wherein said tail segment adjoining said cylindrical body segment is substantially hollow.

8. The configuration according to claim 1, which comprises a tail segment adjoining said cylindrical body segment opposite from said tip segment, said tail segment having an outline surface smoothly merging from said cylindrical body segment inward to a further cylindrical tail segment having a smaller diameter than said cylindrical body segment, and having a backwall substantially orthogonal to said longitudinal axis.

9. The configuration according to claim 1, wherein said smaller diameter is approximately half a diameter of said cylindrical body segment.

10. The configuration according to claim 1, which comprises a tail segment having a material composition with a specific weight less than a specific weight of said tip segment.

11. A projectile configuration, comprising:

a cylindrical body segment having a center axis and a periphery;

a tip segment adjoining said cylindrical body segment and smoothly merging from said cylindrical body segment to a tip, said tip segment being defined, in section, by a convex segment adjoining said cylindrical body segment and a concave segment adjoining said tip along a function y=s tan x, where x and y are Cartesian coordinates and y extends parallel to said center axis, and s is a real number greater than zero.

12. The projectile according to claim 1, wherein said tip is a sharp tip.

13. The projectile according to claim 11, wherein said tip is a sharp tip.

* * * * *